US005698075A

United States Patent [19]

Troughton et al.

[11] Patent Number: 5,698,075

[45] Date of Patent: Dec. 16, 1997

[54] PROCESS FOR BLEACHING A CHEMICAL PAPER PULP IN AN OXYGEN-PEROXYMONOSULFURIC ACID-HYDROGEN PEROXIDE SEQUENCE

[75] Inventors: Nicholas Troughton, Brussels; Marc Hoyos, Mons; Marcel Robberechts, Beersel; Gilbert Vrambout, Brussels, all of Belgium

[73] Assignee: Solvay Interox (Société Anonyme), Brussels, Belgium

[21] Appl. No.: 108,725

[22] PCT Filed: Mar. 3, 1992

[86] PCT No.: PCT/EP92/00469

§ 371 Date: Sep. 3, 1993

§ 102(e) Date: Sep. 3, 1993

[87] PCT Pub. No.: WO92/15752

PCT Pub. Date: Sep. 17, 1992

[30] Foreign Application Priority Data

Mar. 11, 1991 [BE] Belgium ..... 09100226

[51] Int. Cl.[6] ..... D21C 9/147; D21C 9/16

[52] U.S. Cl. ..... 162/65; 162/76; 162/78; 162/89

[58] Field of Search ..... 162/76, 78, 88, 162/89, 65

[56] References Cited

U.S. PATENT DOCUMENTS 5,091,054 2/1992 Meier et al. ..... 162/76

FOREIGN PATENT DOCUMENTS

| | | | |
|---|---|---|---|
| 019 963 | 12/1980 | European Pat. Off. | 162/78 |
| 165 867 | 12/1985 | European Pat. Off. | 162/78 |
| 0190723A1 | 8/1986 | European Pat. Off. . | |
| 402 335 | 12/1990 | European Pat. Off. | 162/78 |
| 0415149A2 | 3/1991 | European Pat. Off. . | |
| 860598 | 1/1986 | South Africa . | |
| 79/00637 | 9/1979 | WIPO . | |

OTHER PUBLICATIONS

"Encyclopedia of Chemical Technology"; Kirk–Othmer; 3rd edition,, vol. 19, New York 1982, p. 415, 3rd paragraph and p. 416, 1st and 2nd paragraphs.

"Paperi ja Puu"; vol. 72, No. 10, 1990, pp. 967–973; Minor, J.L.; Springer, E.L.: wood fibers with peroxymonosulfate.

Ruhanen et al, "First–stage Bleaching of Softwood Kraft Pulp With Peroxide, Instead of Chlorine", *TAPPI J.*, Sep. 1982.

*Primary Examiner*—Steven Alvo

*Attorney, Agent, or Firm*—Spencer & Frank

[57] ABSTRACT

A process for bleaching a chemical paper pulp, including, in the order recited, subjecting the chemical paper pulp to treatment with oxygen in a preliminary delignification stage which does not employ chlorine in an acidic medium or a combination of chlorine and chlorine dioxide in an acidic medium; subjecting the chemical paper pulp to treatment with peroxymonosulphuric acid in a peroxymonosulphuric acid stage carried out at a temperature ranging between 75° and 100° C. for a period ranging between 70 and 150 minutes and at a pulp consistency of ranging between 12 and 25% of dry matter; and subjecting the chemical paper pulp to treatment with alkaline hydrogen peroxide in an alkaline hydrogen peroxide stage.

9 Claims, No Drawings

PROCESS FOR BLEACHING A CHEMICAL PAPER PULP IN AN OXYGEN-PEROXYMONOSULFURIC ACID-HYDROGEN PEROXIDE SEQUENCE

BACKGROUND OF THE INVENTION

1. Field of the Invention

The invention relates to a process for bleaching cellulose paper pulps belonging to the category of chemical pulps.

2. Description of the Related Art

It is known to treat unbleached chemical paper pulps obtained by cooking lignocellulosic substances by means of a sequence of stages of delignifying and/or bleaching treatment involving the use of oxidising chemical products. The first stage of a conventional sequence for bleaching a chemical pulp is intended to complete the delignification of the unbleached pulp in the form in which it is after the cooking operation. This first delignifying stage is traditionally carried out by treating the unbleached pulp with chlorine in an acidic medium or with a chlorine-chlorine dioxide combination, as a mixture or in sequence, so as to react with the residual lignin in the pulp and to give rise to chlorolignins which can be extracted from the pulp by solubilisation of these chlorolignins in an alkaline medium in a subsequent treatment stage.

For various reasons it is found to be useful, in certain situations, to be able to replace this first delignifying stage by a treatment which no longer makes use of a chlorine-containing reactant.

Since approximately ten years or so ago it has been proposed to replace, at least partially, the first stage of the treatment by means of chlorine or of the combination of chlorine and chlorine dioxide by a stage with gaseous oxygen in an alkaline medium. (Kirk-Othmer Encyclopedia of Chemical Technology, 3rd edition, vol. 19, New York 1982, * page 415, 3rd paragraph and page 416, 1st and 2nd paragraphs *). The degree of delignification which is obtained by this oxygen treatment is not sufficient, however, if the aim is to produce chemical pulps of high brightness.

In International Patent Application WO-79/00,637 in the name of Mo Och Domsjö it has been proposed to bleach chemical paper pulp by means of hydrogen peroxide in an acidic medium in the presence of a complexing agent. However, the brightness obtained using this technique is not very high. Moreover, the cellulose undergoes an appreciable degradation.

The invention remedies these disadvantages of the known processes by providing a new process for delignification and/or bleaching of chemical paper pulps, which enables high brightness levels to be reached without excessively degrading the cellulose.

SUMMARY OF THE INVENTION

To this end, the invention relates to a process for bleaching a chemical paper pulp not comprising any preliminary stage of delignification using chlorine in an acidic medium or using the combination of chlorine and chlorine dioxide in an acidic medium, according to which the pulp is subjected to a treatment in two successive stages comprising, in this order: treatment using peroxymonosulphuric acid and treatment using alkaline hydrogen peroxide, the stage peroxymonosulphuric acid being carried out at a temperature of between 75° and 100° C. for a period of between 70 and 150 minutes and at a pulp consistency of between 12 and 25% of dry matter.

According to the invention, a chemical paper pulp is intended to denote the pulps which have undergone a delignifying treatment in the presence of chemical reactants such as sodium sulphide in an alkaline medium (kraft or sulphate cooking), sulphur dioxide or a metal salt of sulphurous acid in an acidic medium (sulphite cooking). Semi-chemical pulps such as those where the cooking has been carried out with the aid of a salt of sulphurous acid in a neutral medium (neutral sulphite cooking, also known as NSSC cooking) can also be bleached by the process according to the invention.

The latter is intended particularly for pulps which have undergone a kraft cooking and whose residual lignin content after cooking lies in the range of kappa numbers of between 8 and 35, depending on the type of wood species from which they originate and the efficiency of the cooking process. All kinds of woods employed for the production of chemical pulps are suitable for implementing the process of the invention and, in particular, those employed for kraft pulps, namely resinous woods such as, for example, the various species of pine and fir and deciduous woods such as, for example, beech, oak and hornbeam.

A preliminary stage of delignification using chlorine in an acidic medium is intended to denote the first stage of a bleaching sequence in which an aqueous solution of gaseous chlorine at a pH of less than 4 is used. Similarly, a preliminary stage of delignification using a combination of chlorine and chlorine dioxide in an acidic medium refers to a delignifying treatment using a mixture of an aqueous solution of gaseous chlorine and of an aqueous solution of chlorine dioxide at a pH of less than 4 or else to a sequential treatment using an aqueous solution of chlorine and then using an aqueous solution of chlorine dioxide or using the same reactants applied in the reverse order, the pH being less than 4 in each case.

The first stage of treatment of the paper pulp according to the invention consists of a treatment with peroxymonosulphuric acid. Peroxymonosulphuric acid (also known as Caro's acid) is intended to note the inorganic acid corresponding to the formula $H_2SO_5$ or one of its alkali metal, alkaline-earth metal or ammonium salts, or else a mixture of a number of these salts or of peroxymonosulphuric acid with one or more of these salts. In an advantageous alternative form of the process according to the invention the peroxymonosulphuric acid or the salts used may have been prepared immediately before their use by reacting a concentrated aqueous solution of sulphuric acid or of its salts with a concentrated aqueous solution of a peroxygen compound, for example hydrogen peroxide. Concentrated solutions are intended to denote solutions of $H_2SO_4$ in a concentration of more than 10 moles per liter and of $H_2O_2$ in a concentration greater than 20% by weight.

The first stage of the process according to the invention may be carried out preferably in the presence of a stabilizing agent. Known stabilisers for peroxygen compounds are suitable. Examples of such stabilisers are the alkaline-earth metal salts, in particular the soluble magnesium salts, soluble inorganic phosphates and polyphosphates such as alkali metal pyrophosphates and metaphosphates, organic polycarboxylates such as tartaric, citric, gluconic, diethylenetriaminepentaacetic and cyclohexanediaminetetraacetic acids and their soluble salts, poly-α-hydroxyacrylic acids and their soluble salts, and organic polyphosphonates such as ethylenediaminetetramethylenephosphonic, diethylenetriaminepenta(methylenephosphonic) and cyclohexanediaminetetramethylenephosphonic acids and their soluble salts. It is also possible to combine a number of these stabilising salts as a mixture. As a general rule, organic polycarboxylates and polyphosphonates give good results, in particular when they are combined with a soluble magnesium salt. The combination of a soluble magnesium salt such as $MgSO_4$ and of diethylenetriaminepentaacetic acid (DTPA) is preferred in concentrations of 0.02 to 0.2 g $MgSO_4$/100 g of dry pulp and of 0.05 to 0.3 g DTPA/100 g of dry pulp respectively.

The stage of treatment of the paper pulp with peroxymonosulphuric acid is generally carried out under atmospheric pressure conditions and at a temperature which is sufficient to ensure an efficient consumption of the peroxymonosulphuric acid and, at the same time, not too high so as not to degrade cellulose and not to overburden the energy cost of the means of heating used in the said stage. The temperature range of between 85° and 95° C. is preferred. The best results were obtained at 90° C.

The duration of the stage of treatment with peroxymonosulphuric acid must be sufficient to ensure a complete reaction. Although longer periods have no effect on the degree of delignification of the pulp or on its intrinsic strength properties, it is not recommended to extend the reaction period beyond that necessary to complete the reaction, in order to limit the capital costs and the energy costs of heating the pulp. In practice, the reaction period is related to those of the chosen temperature, the highest temperatures permitting the shortest period. Periods of between 85 and 130 minutes are preferred and are generally sufficient. Periods of 90 and 120 minutes gave excellent results.

According to the invention, the stage of treatment with peroxymonosulphuric acid is carried out at a pulp consistency of between 12 and 25% of dry matter. It is advantageous that this consistency be between 14 and 20% of dry matter. The consistency of 15% of dry matter gave excellent results.

The second stage of treatment of the process according to the invention consists of a stage with alkaline hydrogen peroxide. This stage is carried out in a manner similar to a traditional alkaline extraction stage in which an aqueous solution of hydrogen peroxide is added to the alkaline reactant. The quantities of hydrogen peroxide to be used in this stage depend on the content of residual lignin which is present in the pulp and on the nature of the wood which has been used to manufacture it. As a general rule, these quantities will be between 0.3 and 3.0 g $H_2O_2$/ 100 g of dry pulp, and preferably between 0.5 and 2.0 g $H_2O_2$/100 g of dry pulp. The nature of the alkali employed must therefore be such that it exhibits good efficiency at the same time as good solubility. An example of such an alkali is sodium hydroxide in aqueous solution. The alkali content must be adjusted to ensure a complete consumption of peroxide at the end of the reaction. Alkali contents of between 1 and 3 g of alkali, expressed as NaOH per 100 g of dry pulp, are suitable. Quantities of $H_2O_2$ of 1 g $H_2O_2$/100 g of dry pulp and of NaOH of 2 g NaOH/100 g of dry pulp gave excellent results.

In an alternative form of the process according to the invention, if it is desired to obtain high brightness levels, the second stage of treatment may be followed by a sequence of traditional bleaching stages optionally involving chlorine-containing reactants. The following are examples of such stages: chlorine dioxide, sodium hypochlorite, extractions with caustic soda in the presence or absence of hydrogen peroxide. It is possible, for example, to follow the third stage of the process according to the invention with the sequence of the two additional chlorine dioxide-alkaline hydrogen peroxide stages. The addition of a sixth stage in which chlorine dioxide is used allows a brightness of 90° ISO to be reached with ease.

Another alternative form of the process according to the invention consists in preceding the treatment of the chemical paper pulp by an oxygen treatment. This oxygen treatment is carried out by bringing the unbleached pulp into contact with gaseous oxygen at a pressure of between 20 and 1000 kPa in the presence of an alkaline compound in a quantity such that the weight of alkaline compound relative to the weight of dry pulp is between 0.5 and 4.0%. The temperature of the first stage must be adjusted in the range of between 70° and 130° C. and preferably between 80° and 120° C. The duration of the oxygen treatment must be sufficient for the reaction of oxygen with the lignin present in the pulp to be complete. However, it cannot exceed this reaction time too much, otherwise degradation is induced in the cellulose chain structure of the pulp. In practice, it will be set at a value of between 30 and 120 minutes, and preferably between 40 and 80 minutes. A combination of the temperature and duration conditions of 90° C. and 60 minutes gave good results.

The pretreatment with oxygen can also be combined with the two stages of treatment according to the invention and with the subsequent conventional bleaching stages.

The process according to the invention finds an application for the bleaching of chemical pulps of the kraft or sulphite type, or of semichemical high quality pulps, especially those which are intended for food packaging. It is equally well suited for pulps originating from resinous wood or deciduous wood.

DESCRIPTION OF THE PREFERRED EMBODIMENTS

The following examples are given to illustrate the invention without, however, limiting its scope. Examples 1R and 2R are not in accordance with the invention and have been given by way of reference. Examples 3 to 5 are in accordance with the invention.

Example 1R (Not in Accordance with the Invention)

A sample of chemical pine pulp which had undergone a kraft cooking (initial brightness 29.3° ISO measured according to ISO standard 2470, kappa number 27.6 measured according to SCAN standard C1:59 and degree of polymerisation of cellulose 1350 measured according to SCAN standard 15:62) was mixed with 1.4% by weight of $H_2SO_4$ relative to the dry pulp and was placed in a polyethylene bag. Demineralised water was then introduced into the bag to bring the pulp consistency to 15% of dry matter and the bag was then kneaded and carefully closed. It was then placed in a bath of water controlled thermostatically at 90° C. and the reaction was allowed to proceed for 90 minutes. At the end of this first stage of treatment the pH of the pulp was 2.2.

After reaction the bag was taken out of the thermostat and was then opened and the pulp was washed in a volume of demineralised water corresponding to 40 times its dry weight. The pulp was then filtered on a Buchner filter and was then placed in a polyethylene bag and was mixed with 1.0% by weight of hydrogen peroxide and 2.7% by weight of NaOH relative to the dry pulp and of demineralised water in a quantity adjusted to bring its consistency to 15% of dry matter. The polyethylene bag containing the sample and the reactants was then immersed, after having been carefully kneaded, in a bath of water controlled thermostatically at 90°

C. After. 120 minutes' reaction the pulp was washed in a volume of demineralised water corresponding to 40 times its dry weight and was filtered on a Buchner filter. The brightness of the treated pulp was then determined in accordance with the operating method described in ISO standard 2470 and the kappa number (residual lignin content) was determined in accordance with SCAN standard C1:59.

The result of the measurements was 42.9° ISO in the-case of the brightness and 14.4 in the case of the kappa number.

Three conventional bleaching stages with chlorine dioxide, hydrogen peroxide and chlorine dioxide were then performed by the same operating technique in order to carry out the overall bleaching sequence A $P_1$ $D_1$ $P_2$ $D_2$ under the following conditions:

a) stage $D_1$ quantity of $ClO_2$: 4% by weight relative to the dry paste consistency: 12% of dry matter duration: 150 minutes temperature: 70° C.

b) stage $P_2$ quantity of $H_2O_2$: 0.15% by weight relative to the dry pulp quantity of NaOh: 0.5% by weight relative to the dry pulp consistency: 12% of dry matter duration: 120 minutes temperature: 70° C.

c) stage $D_2$ quantity of $ClO_2$: 1% by weight relative to the dry pulp consistency: 12% of dry matter duration: 120 minutes temperature: 70° C.

The following results were measured:

a) after stage $D_1$ brightness: 52.9° ISO b) after stage $P_2$ brightness: 64.1° ISO c) after stage $D_2$ brightness: 79.8° ISO kappa number: 1.6 degree of polymerisation of cellulose: 1020

Example 2R (Not in Accordance with the Invention)

Example 1R was reproduced with the addition of hydrogen peroxide in the first acidic stage in a proportion of 0.15% relative to the dry pulp, all the other conditions remaining the same. The results were as follows:

a) after stage $P_1$ brightness: 44.2° ISO kappa number: 13.3 b) after stage $D_1$ brightness: 59.6° ISO c) after stage $P_2$ brightness: 66.4° ISO d) after stage $D_2$ brightness: 82.0° ISO kappa number: 1.4 degree of polymerisation of cellulose: 860

Examples 3 and 4 (In Accordance with the Invention)

Example 1R was reproduced with the first sulphuric acid stage replaced by a peroxymonosulphuric acid stage in which 0.5% by weight of Caro's acid relative to the dry pulp was used, all the other conditions remaining the same. In Example 4 the following products were also added as stabilisers, in the peroxymonosulphuric acid first stage: 0.2% by weight of diethylenetriaminepentaacetic acid (DTPA) and 0.1% by weight of $MgSO_4$ relative to the dry pulp.

The results were as follows:

| | Example 3 | Example 4 |
|---|---|---|
| a) after stage $P_1$ | | |
| brightness, °ISO | 42.5 | 41.7 |
| kappa number | 13.0 | 13.5 |
| b) after stage $D_1$ | | |
| brightness, °ISO | 58.8 | 57.8 |
| c) after stage $P_2$ | | |
| brightness, °ISO | 71.2 | 70.7 |
| d) after stage $D_2$ | | |
| brightness, °ISO | 85.1 | 85.8 |
| kappa number | 1.1 | 1.1 |
| degree of polymerisation of cellulose | 910 | 1020 |

Example 5 (In Accordance with the Invention)

The same sample of kraft pine pulp was mixed with 3.0% by weight of NaOH and 0.1% by weight of $MgSO_4$ relative to the dry pulp and was placed in an autoclave fitted with a mechanical stirring system. Demineralised water was then introduced into the autoclave to bring the pulp consistency to 15% of dry matter, and gaseous oxygen was introduced at a pressure of 600 kPa. The temperature was raised to 110° C. and reaction was allowed to proceed with stirring for 60 minutes.

After the reaction, the autoclave was opened and the pulp was washed in a volume of demineralised water corresponding to 40 times its dry weight. The pulp was then filtered on a Buchner filter and was then subjected to a bleaching according to the sequence Ca $P_1$ $D_1$ $P_2$ $D_2$ under conditions which were identical with those of Example 4 except for the quantity of $ClO_2$ in stage $D_1$, which was reduced to 3.0 g $ClO_2$/100 g of dry pulp.

The results were as follows:

a) after stage O brightness, °ISO: 35.2 kappa number: 15.8 b) after stage Ca brightness, °ISO 37.8 c) after stage $P_1$ brightness, °ISO: 53.7 kappa number 7.5 d) after stage $D_1$ brightness, °ISO 71.8 e) after stage $P_2$ brightness, °ISO: 81.4 f) after stage $D_2$ brightness, °ISO: 90.8 kappa number 0.5

What is claimed is:

1. A process for bleaching a chemical paper pulp, consisting of, in the order recited:

a. subjecting the chemical paper pulp to treatment with oxygen by contacting unbleached chemical paper pulp with gaseous oxygen in the presence of an alkaline compound at a pressure ranging between 20 and 1000 kPa, at a temperature ranging between 70° and 130° C., and for a duration ranging between 30 and 120 minutes, in a preliminary delignification stage which does not employ chlorine in an acidic medium or a combination of chlorine and chlorine dioxide in an acidic medium;

b. subjecting the chemical paper pulp to treatment with peroxymonosulphuric acid in a peroxymonosulphuric acid stage carried out at a temperature ranging between 75° and 100° C. for a period ranging between 70 and 150 minutes and at a pulp consistency of ranging between 12 and 25% of dry matter; and c. subjecting the chemical paper pulp to treatment with alkaline hydrogen peroxide in an alkaline hydrogen peroxide stage.

2. The process according to claim 1, wherein the peroxymonosulphuric acid stage is carried out in the presence of a stabilizing agent.

3. The process according to claim 2, wherein the stabilizing agent comprises a mixture of a soluble magnesium salt and diethylenetriaminepentaacetic acid.

4. The process according to claim 1, wherein the peroxymonosulphuric acid stage takes place at a temperature ranging between 85° and 95° C. for a period ranging between 85 and 130 minutes and at a pulp consistency ranging between 14 and 20% of dry matter.

5. The process according to claim 4, wherein the peroxymonosulphuric acid stage takes place at a temperature of 90° C. for a period of 90 minutes and at a pulp consistency of 15% of dry matter.

6. The process according to claim 1, wherein, in the alkaline hydrogen peroxide stage, hydrogen peroxide is employed in a quantity ranging between 0.3 and 3.0 g $H_2O_2$/100 g of dry pulp.

7. The process according to claim 6, wherein, in the alkaline hydrogen peroxide stage, hydrogen peroxide is employed in a-quantity ranging between 0.5 and 2.0 g $H_2O_2$/20 g of dry pulp.

8. The process according to claim 1, wherein the chemical paper pulp is a kraft pulp.

9. A process for bleaching a chemical paper pulp, comprising, in the order recited:

a. subjecting the chemical paper pulp to treatment with oxygen by contacting unbleached chemical paper pulp with gaseous oxygen in the presence of an alkaline compound at a pressure ranging between 20 and 1000 kPa, at a temperature ranging between 70° and 130° C., and for a duration ranging between 30 and 120 minutes, in a preliminary delignification stage which does not employ chlorine in an acidic medium or a combination of chlorine and chlorine dioxide in an acidic medium;

b. subjecting the chemical paper pulp to treatment with peroxymonosulphuric acid in a peroxymonosulphuric acid stage carried out at a temperature ranging between 75° and 100° C. for a period ranging between 70 and 150 minutes and at a pulp consistency of ranging between 12 and 25% of dry matter;

c. subjecting the chemical paper pulp to treatment with alkaline hydrogen peroxide in an alkaline hydrogen peroxide stage;

d. subjecting the chemical paper pulp to treatment with chlorine dioxide;

e. subjecting the chemical paper pulp to treatment with hydrogen peroxide in an alkaline medium; and f. subjecting the chemical paper pulp to treatment with chlorine dioxide.

* * * * *